US005814351A

United States Patent [19]

Mower

[11] Patent Number: 5,814,351

[45] **Date of Patent: *Sep. 29, 1998**

[54] OUTSIDE CORNER MASTIC APPLICATOR

[75] Inventor: Morris F. Mower, Riverton, Utah

[73] Assignee: Axia Incorporated, Oak Brook, Ill.

[ * ] Notice: The term of this patent shall not extend beyond the expiration date of Pat. No. 5,670,182.

[21] Appl. No.: 710,686

[22] Filed: Sep. 23, 1996

Related U.S. Application Data

[63] Continuation-in-part of Ser. No. 389,142, Feb. 15, 1995, Pat. No. 5,670,182.

[51] Int. Cl.[6] ..... B05B 11/02

[52] U.S. Cl. ..... 425/87; 401/48; 401/193; 425/458

[58] Field of Search ..... 425/87, 458; 401/48, 401/138, 171, 176, 193

[56] References Cited

U.S. PATENT DOCUMENTS

| | | | |
|---|---|---|---|
| 2,809,513 | 10/1957 | Ames | 425/87 |
| 2,824,442 | 2/1958 | Ames | 401/48 |
| 2,889,699 | 6/1959 | Ames | 425/87 |
| 4,132,517 | 1/1979 | Ames | 401/48 |
| 4,516,868 | 5/1985 | Molnar | 401/5 |
| 4,907,955 | 3/1990 | Snipes | 401/93 |
| 5,137,386 | 8/1992 | Mower | 401/171 |

*Primary Examiner*—Patrick Ryan
*Assistant Examiner*—Iurie A. Schwartz
*Attorney, Agent, or Firm*—Larry L. Saret; Laff, Whitesel, Conte & Saret, Ltd.

[57] ABSTRACT

An applicator for drywall mastic can alternatively cover flat drywall joints, outside corner drywall joints, or simultaneously both outside corners on a stub drywall, all with little or no manual adjustment of the applicator. A spring biased lever is pivotally mounted on each side of the applicator. Normally, the bias extends a projection on the lever which rides over the edge of the outside corner in order to guide and direct the applicator as it moves along a corner wall. A circumferential flange on a wheel cooperates with the projection to give greater stability. If the applicator is pressed against a flat wall, the projection is pushed back against the bias of the spring so that the projection has no effect.

21 Claims, 5 Drawing Sheets

OUTSIDE CORNER MASTIC APPLICATOR

This is a continuation-in-part of Ser. No. 08/389,142, filed Feb. 15, 1995 now U.S. Pat. No. 5,670,182.

Field

This invention relates to tools used during the installation or repair of wall board, drywall, or other surfaces, and more particularly, to an apparatus for applying joint compound or mastic to outside corners of such surfaces.

Background

Wall board or drywall panels are generally erected with abutting edges. The gap between the abutting edges of such adjacent panels, sometimes referred to as a wall joint, generally must be taped and filled with joint compound or mastic. Often, several coats of mastic are applied, with the last being a finishing coat. Thus, construction with drywall may involve numerous coats of mastic applied to numerous wall joints.

When two adjacent panels lie on the same surface, their abutting edges form a flat wall joint. Mastic applicators for filling such flat wall joints more quickly have been developed, such as those disclosed in U.S. Pat. Nos. 2,824,442; 2,984,857; and 3,888,611 to R. G. Ames. These applicators, sometimes referred to as "Ames boxes," generally include a housing in which a quantity of mastic can be stored, a moveable plate which can be pushed against the quantity of mastic, and an outlet through which the mastic flows to the selected surface. The flow of mastic from the housing can often be regulated by the drywall finisher as the outlet is passed over the surface to receive the mastic.

These mastic applicators, however, are not adapted for use in finishing wall joints occurring at outside corners. For example, sometimes the applicator cannot be accurately aligned with the corner, which may cause excess mastic to exit from the mastic tool past the edge of the corner.

In addition, corner joints are often reinforced by using corner trim or corner beads, which are strips of metal or plastic which extend along one or both sides of the corner. The corner bead may be slightly raised from the wall surfaces at the edge of the corner, which may make it difficult to use mastic applicators of the type designed for flat joints in these situations.

Another problem relates to an application of mastic to stub walls. The term "stub wall" refers to a wall with a relatively short thickness, generally equal to the width of a piece of lumber having width and depth dimensions of about two inches by four inches ("2×4") plus the overlying drywall on either side of the 2×4. For example, stub walls may occur at the exposed end of a partition wall between the two opposing surfaces of the partition wall.

The stub wall thus has two opposite, outside corners. It is generally difficult to apply mastic to these corners by using conventional applicators. In addition, when the span or width of the stub wall is less than the width of the mastic applicator, mastic from conventional applicators may undesirably flow out at a point far removed from one or both of the stub wall sides.

Because of the problems associated with using flat-joint mastic applicators on outside corners and stub walls, drywall finishers often forego the convenience of using applicators with housings which store a quantity of mastic for regulated application to the surface. Instead, finishers have generally had to use joint compound knives with either a single straight edge or with two surfaces at right angles to each other. Mastic is scooped onto these knives and then applied to the corner joint.

Since the finisher must repeatedly add mastic to such a knife, as well as scrape off the excess between application strokes, applying mastic to outside corners is much slower than applying it to flat joints by means of mastic applicators with housings. In addition, use of these corner knives requires far more skill to achieve the desired smoothness of the coat than using mastic applicators with housings. Often, coats of mastic applied with knives are not as uniform, aesthetically pleasing, or consistent as those using mastic applicators with housings. It is also inconvenient to carry a separate set of tools for applying drywall to outside corners.

One attempt to improve an application of mastic to outside corners, disclosed in Milburn U.S. Pat. No. 5,069,610, involves attaching sliding corner guard members to the sides of conventional flat-joint mastic applicators. The corner guard members have flat end portions which can be brought against the corner to be finished in order to inhibit the applicator from being moved away from the corner that is receiving the mastic.

However, the attempted solution of Milburn has various drawbacks and disadvantages. For example, when the applicator is positioned with the corner guard against the corner, mastic cannot be applied effectively at the corner bead, generally causing a gap in the mastic to form between the corner bead and the beginning of the coat of mastic. In addition, the corner guards must be manually slid into and out of position, a process which can become especially cumbersome when the user needs to rapidly alternate between applying mastic to one or the other side of a corner, or between flat joints and corner joints. Also, the structure disclosed by Milburn does not address the difficulties in applying mastic to stub walls.

Thus, there is a need for a mastic applicator which allows outside corners to be efficiently and effectively coated with mastic or drywall compound.

SUMMARY

Accordingly, an object of this invention is to provide a mastic applicator which can function effectively both at corner joints and at flat joints.

Another object is to provide a mastic applicator for stub walls.

Still another object is to have the mastic applicator adjustable to accommodate stub walls of varying widths.

Yet another object is to provide an applicator which follows a truer path down an outside edge of a drywall, and which may be switched quickly and easily between flat and corner joints.

According to the present invention, the foregoing and other objects and advantages are attained by a drywall apparatus which includes a mastic applicator. The mastic applicator has an applicator surface with an outlet from which the mastic flows onto an area to receive the mastic. The applicator also has portions which guide one or both of the side edges of the outlet along an outside corner of the area to receive the mastic. These guide portions include corner guide plates which are pivotally mounted to move between deployed and retracted positions. When deployed, a projection on the guide plates rides against the corner bead in order to guide and direct the applicator as it applies the mastic. The guide plates may also be retracted so that the projection is generally coplanar with the applicator surface for use on flat surface wall board joints.

According to another aspect of the invention, the applicator includes stub guides laterally spaced from each other so that a stub wall fits between the stub guides. The stub guides can be laterally adjusted to fit against both outside corners of the stub wall simultaneously. In addition, the position of the side edges of the outlet can be varied to make the outlet wider or narrower, depending on the width of the stub wall to receive the mastic.

Still other objects, advantages, and novel aspects of the present invention will become apparent in the detailed description of the invention that follows, in which the preferred embodiment of the invention is shown by way of illustration of the best mode contemplated for carrying out the invention, and by reference to the attached drawing in which:

DESCRIPTION

Figure 1B:
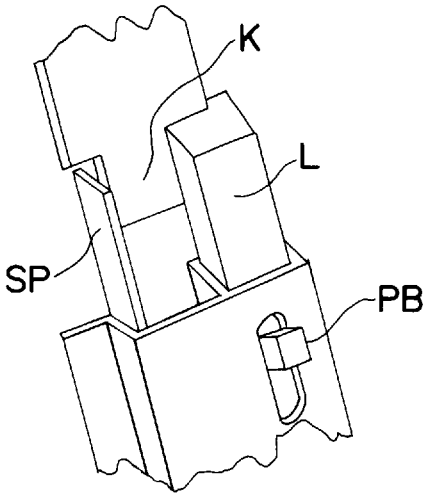
FIG. 1B is a portion of FIG. 1A which is enlarged to show a latch and bias spring.

In a first embodiment (FIG. 1), an apparatus according to the present invention includes a mastic applicator 21 adapted to be mounted on an end of a conventional handle or wand. The mastic applicator 21 includes an applicator surface 23. Front and back walls 26 have side walls 25 which extend generally perpendicularly between the front and back walls to form the perimeter of a rectangular applicator housing in which mastic can be stored.

The applicator surface 23 is generally planar and includes a blade 35 located at the top edge of the applicator surface 23. An aperture 27 is an outlet for the mastic to pass from the housing to the drywall. The aperture is located proximate to the blade 35. A stub-wall assembly 37 is mounted on the applicator surface 23 and can be slid toward and away from the outlet 27, as discussed in more detail below. A pair of laterally-spaced rollers or wheels 39 are toggle-mounted at the bottom edge of the applicator surface 23. These rollers rest on the drywall to support the applicator.

In use, the blade 35 and wheels 39 ride on the drywall so that applicator surface 23 is brought near the drywall surface which receives the mastic. The mastic is pressed out of the aperture or outlet 27 in the applicator surface 23 by a conventional press plate (not shown) positioned generally behind the applicator surface 23. As the mastic is being pressed out, the applicator 21 is generally moved in the directions indicated by the Arrow A (wheels leading) to apply a quantity of mastic to the surface. The rollers 39 are designed to contact the surface of the drywall in order to support and aid the movement of the applicator 21 in relation to the surface.

The outlet 27 (FIGS. 1 and 2) extends transversely across the applicator surface and has side edges 29 substantially coinciding with the edge of the applicator surface 23. A corner guide plate 31*a* or 31*b* is pivotally mounted, as at 43, on each of the side walls 25 and near the side edges 29 of the aperture or outlet 27. This corner guide plate 31*a* or 31*b* may be moved between retracted and deployed positions in order to apply mastic to flat wall joints or outside corner joints, respectively. A spring 45 exerts an upward force on the bottom end of guide plate 31*a* (as viewed in FIG. 1). This pivots plate 31 about point 43 in order to lower the upper end of guide plate 31*a* so that projection 32 extends beyond the application plate 23 in order to rest against the metal corner bead to guide the applicator along the corner.

Figure 1:
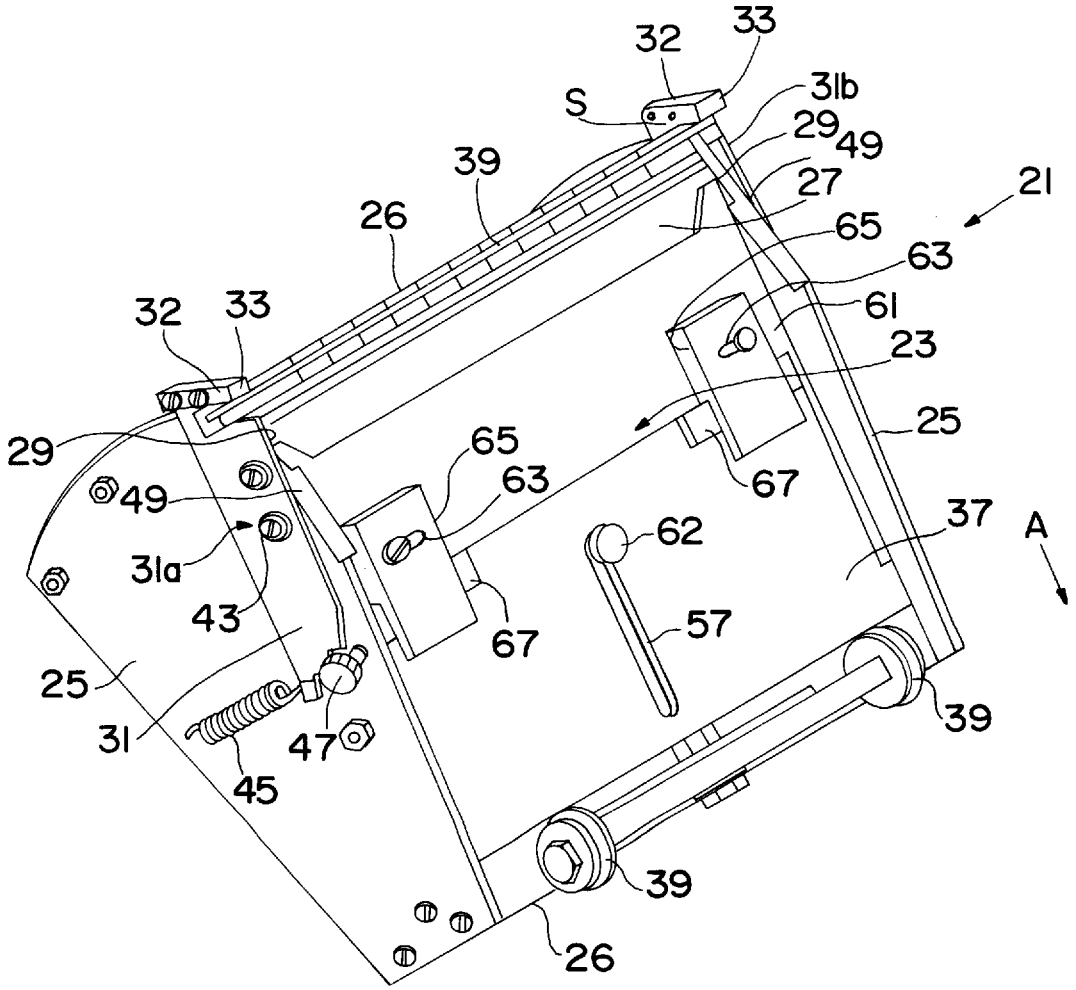
FIG. 1 is a perspective view of a first embodiment of a mastic applicator embodying the present invention.
Figure 2:
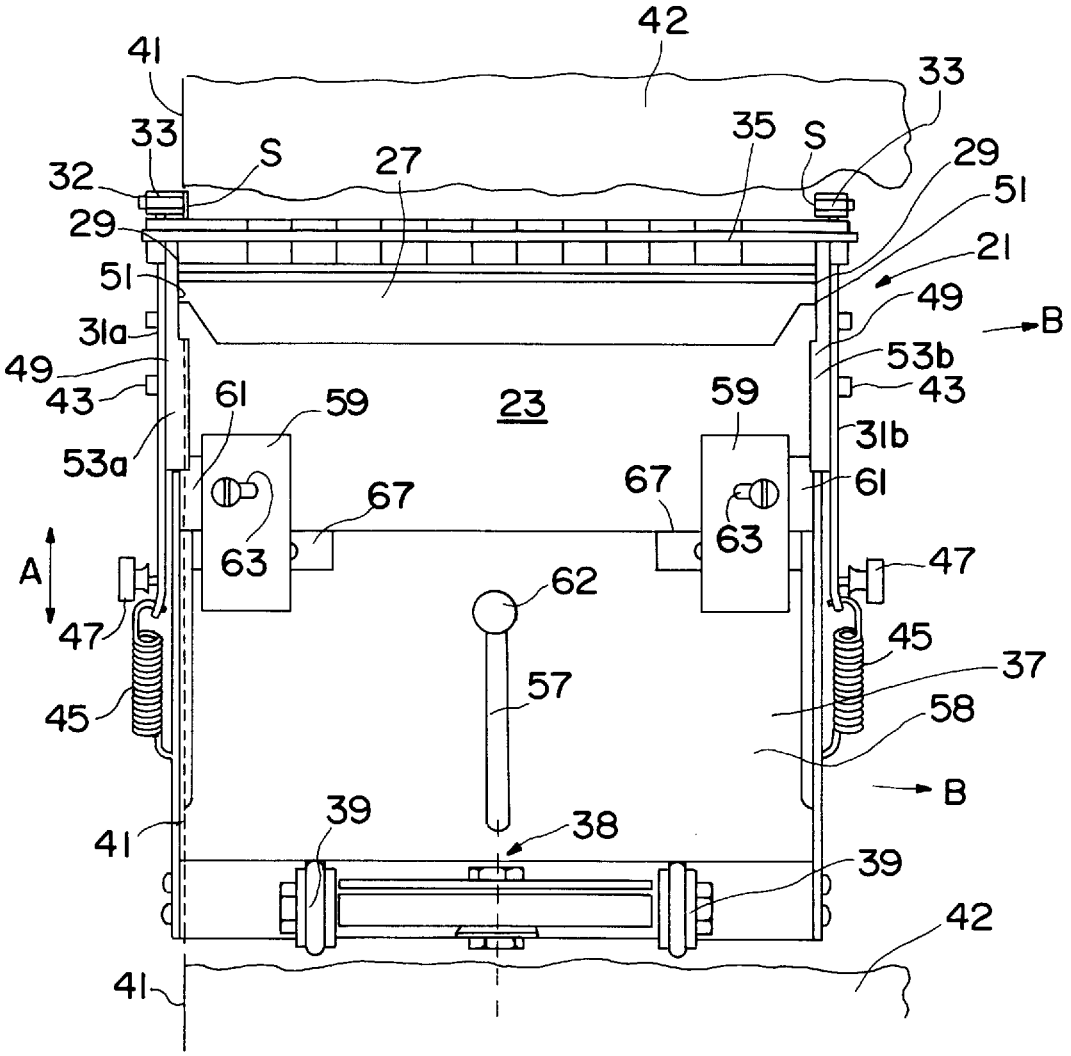
FIG. 2 is a bottom plan view of the applicator of FIG. 1 shown positioned at an outside corner (partially cut away)
Figure 4:
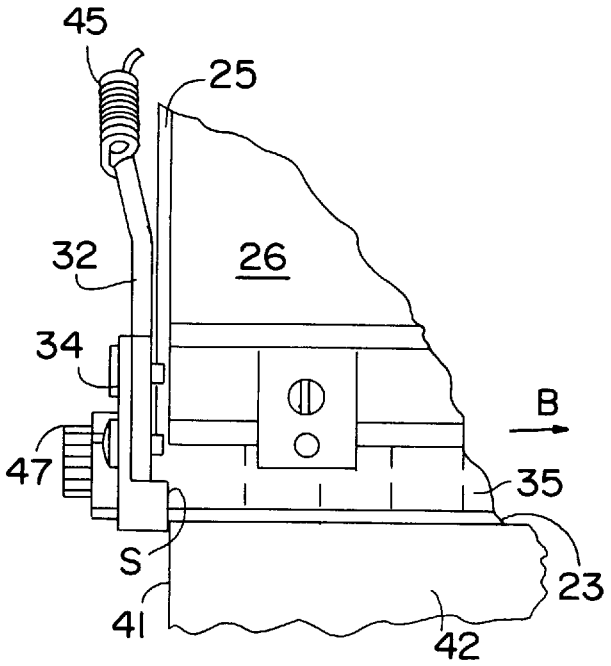
FIG. 4 is an enlarged top plan view of a portion of the applicator embodying the present invention and showing one of the corner guides engaged at an outside corner.

The applicator 21 is shown in FIG. 2 positioned over an area 42 adjacent to an outside corner 41. The outside corner 41 is shown in solid lines and, where broken away, in dotted lines. Each of the corner guide plates 31*a* or 31*b* has a guide surface projection 33 which can be positioned to extend slightly beyond and out of the general plane of the applicator surface 23 as best seen in FIGS. 1 and 4. In this way, when, as seen in FIG. 2, the applicator is positioned over an area 42 adjacent to the outside corner 41, the corner guide plate 31 extends over the edge of the surface 42 (FIG. 4) and engages the metal bead along outside corner 41. The corner guide plates 31 also include rounded surface 32 which is generally parallel to the applicator surface 23 and extends transversely from the guide surface projections 33 so that the rounded surface 32 rides on a flat wall surface.

When the projection 33 on a corner guide plate 31*a* or 31*b* has engaged the outside corner 41, the applicator 21 is inhibited from moving in the direction of arrow B. In effect, then, when the applicator 21 is moved in the direction of arrow A, it is guided along, or maintained in alignment with, the outside corner 41 as if the metal corner bead is a rail or track.

It is important that the corner guide plates 31 have the guide surface projections 33 longitudinally aligned with at least a portion of the side edge 29. In this way, when the projection 33 on a corner guide plate 31 abuts the outside corner 41 of the drywall, it guides the applicator 21 as it travels up or down the wall. The mastic which flows out at the side edge 29 is deposited right up to the edge of the corner or at the corner bead, if so provided. No gap in the mastic coat occurs because projection 33 rides on drywall corner 41 so that there is no gap between the edge of the outside corner 41 and the side edge 29 of the aperture or outlet 27.

Figure 5:
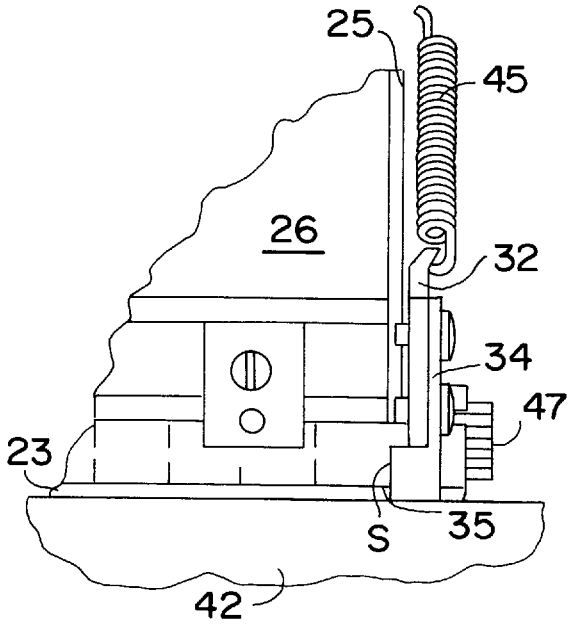
FIG. 5 is an enlarged top plan view of a portion of the applicator embodying the present invention and showing one of the corner guides retracted.

As best seen in FIGS. 1, 4, and 5, the corner guide plates 31*a* or 31*b* pivot around a point 43 and are biased to extend beyond the applicator surface 23 by cylindrical springs 45. One end of the springs 45 is fixed to the sides 25 (FIG. 1) and the opposite end of the spring is attached to an end of the corner guide plates 31*a* or 31*b* opposite the end having the guide surfaces 33. The tension of the springs 45 is sufficiently large so that the corner guide plate 31*a* or 31*b* remains extended beyond surface 23 as it travels against the corner 41 (FIG. 4). However, the spring tension is sufficiently small so that when one of the corner guide plates 31*a* or 31*b* is positioned against a flat wall joint, and is not positioned over the edge of the corner 41, plate 31 retracts under normal operating pressure responsive to the finisher holding the applicator against the flat wall area 42 (FIG. 5). When this happens and the applicator is used against a flat joint, the guide projection 33 is pushed back with the rounded end substantially coplanar with the applicator surface 23. When applying the mastic at the outside corner 41, one of the corner guide plates 31*a* or 31*b* is retracted because it is pressed against the flat part of the wall. The other corner guide plate is extended over the corner edge 41, depending on which side of the corner 41 the mastic applicator is being used.

In addition, because both of the corner guide plates 31*a* or 31*b* are retractable, the applicator 21 may be used on flat surfaces of wall joints, in which case the rounded tips 32 contact the flat wall and both the corner guide plates 31 retract.

From the foregoing, it is seen that a drywall finisher may switch from one side of a corner to the other side, or from corner joints to flat joints, without a need for the finisher to switch tools and without a need to make any substantial adjustment to the corner guide plates 31*a* or 31*b* or to the mastic applicator 21.

The corner guides 31 are also provided with locking screws 47. The corner guides can be moved to a retracted position and locked there by tightening the screws 47.

As best seen in FIG. 2, the applicator surface includes a pair of side skids 49 mounted at the opposite side edges of the applicator surface 23 and adjacent to the aperture or outlet 27. The skids 49 have notched portions which define skid edges 51 aligned with the side edges 29 of the outlet. The skids 49 also have skid surfaces 53*a* or 53*b* which are substantially coplanar with the applicator surface 23. When the applicator 21 is positioned as shown in FIG. 2, the skid surface 53*a* can be brought into contact with the raised portion of the corner bead, if one is present, instead of the blade 35 rubbing against the corner bead. The skid surface 53*a* thus can be used to avoid wear and tear on end portions of the blade 35.

Still referring to FIG. 2, the rollers 39 are toggle mounted to swing about an axis, as indicated at 38. In this way, if one of the rollers 39 encounters a raised portion or other irregularity as it moves over the area 42, the applicator surface is not generally raised away from the wall because of the irregularity, thereby allowing the mastic to be applied smoothly over the irregularity. This toggle-feature may be particularly important when and if the roller 39 closer to the corner 41 rides over the raised surface of a corner bead.

As best seen in the top plan views, each of the corner guide plates 31*a* or 31*b* include an elongated member 32 and an L-shaped member 34 mounted at the end of the elongated member 32 which extends from the applicator surface 23. The L-shaped members 34 extend inwardly from the sides 25 and terminate in alignment with the side edges 29 (FIG. 2). The inner surfaces of guide plates 31*a* or 31*b* in this embodiment form the guide surfaces 33 (FIGS. 1 and 2) for the corner guides 31.

Figure 1A:
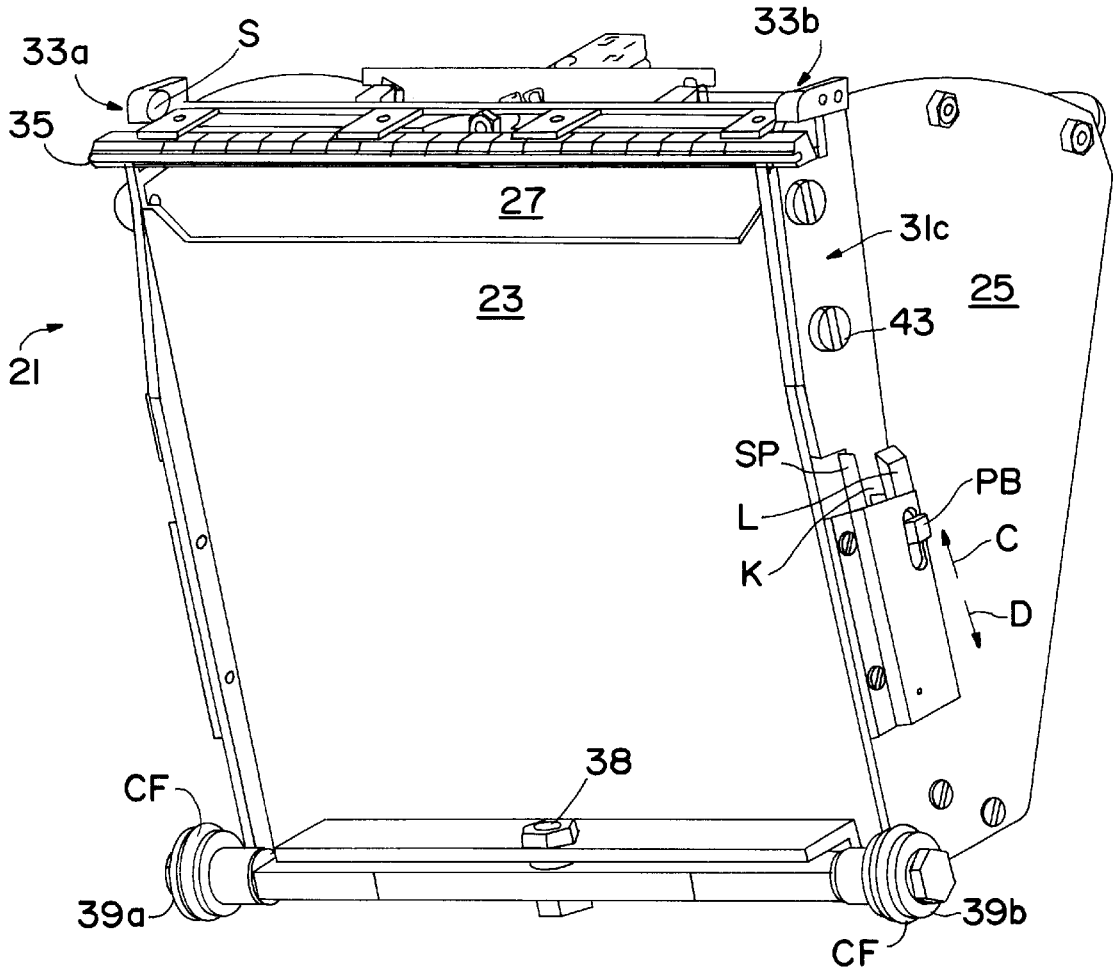
FIG. 1A is a perspective view of a second embodiment of the inventive mastic applicator which may be quickly and easily switched between flat and corner joints.

FIG. 1A shows a second embodiment which is similar to the embodiment of FIGS. 1, 2 where the same reference numerals are used to identify the same parts.

The differences between the two embodiments are that, in the first embodiment (FIGS. 1, 2), a thumb screw 47 is used to lock the corner guide plates 31*a* or 31*b* in retracted position for use on a flat wall surface or in a deployed position so that projection 33*a* or 33*b* may project below the application in order to guide the applicator along the outside corner.

In the second embodiment (FIG. 1A—see also the enlarged fragment in FIG. 1B), a spring SP biases (Direction C) guide plate 31*c* to urge projection 33*b* to a position which may provide a corner guide. The latch L holds the side guide plates 31*c* in an elevated position against the bias of spring SP by engaging one side of a keeper K on the plate 31*c*. To release side guide plate 31*c*, the push button PB is slid back (Direction D), thereby retracting latch L. The bias of spring SP moves guide plate 31*c* to lower guide 33*b* so that it may ride along the corner bead after latch L no longer engages the keeper K. That is, the back end of plate 31*c* is pushed upwardly by the bias of leaf spring SP. Plate 31*c* pivots around point 43 which deploys guide projection 33*b* so that it may bear against the metal corner bead to guide and direct the applicator as it moves up and down the corner edge 54. This keeper-latch arrangement is simpler, quicker, and easier to use.

Another difference in the second embodiment is the position of the wheels 39*a*, 39*b*. In the first embodiment (FIGS. 1, 2), the wheels 39, 39 are close together so that both ride on the wall when mastic is being applied to either a flat wall or an outside corner joint.

In the second embodiment (FIG. 1A), the wheels 39*a*, 39*b* are moved outwardly relative to side walls 25. There is a circumferential flange CF on each wheel, the inside edge of the flange rides along the metal corner bead. The circumferential flange is positioned to be in alignment with, extend over, and ride along the bead of the metal corner pieces along with the deployed corner guide projections 33*a*, 33*b*, as if the beads are rails or tracks. This means that as the applicator is placed over and runs up and down a corner edge bead 41 (Arrow A FIG. 1), there are two aligned points resting against and moving along the edge to guide and stabilize the applicator. This two point support at the edge gives greater stability and produces a smoother coat of mastic.

Figure 3:
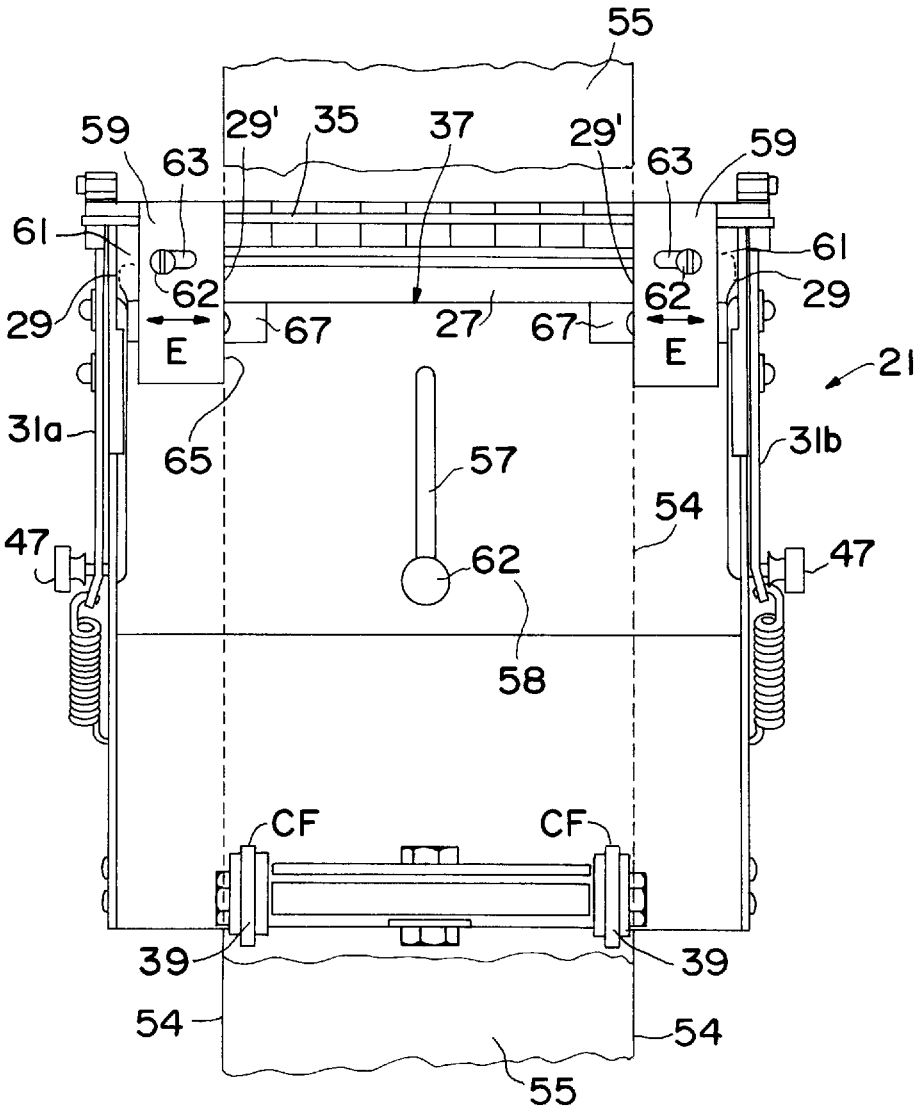
FIG. 3 is a bottom plan view of the applicator of FIG. 1 shown positioned at a stub wall.

The applicator 21 includes a stub-wall assembly 37 shown in its disengaged position in FIG. 2 and in its engaged position in FIG. 3 when the applicator is being used on a stub wall 55. As seen in FIG. 2, the applicator surface 23 is supported by blade 35 and wheels which rest on the drywall area to receive mastic at the rollers 39 and either the blade 35 or side skids 49, thereby forming a plane of contact including those contact points. The stub-wall assembly 37 is generally planar and positionable against the applicator surface so as to be out of the plane of contact with the area to receive mastic when the assembly 37 is positioned at the bottom edge of the applicator surface 23 as shown in FIG. 2. In this position, the assembly 37 does not affect the operation of the applicator 21.

The slot 57 enables assembly 37 to be slidably mounted on the applicator. Set screw 62 can be used to fix the assembly in place relative to the applicator surface 23. The assembly includes a base plate 58 and an oppositely disposed pair of laterally spaced stub guides 59 which extend from the top edge of the base plate 58. The stub guides 59 are mounted onto flange portions 61 which extend from the top edge of the base plate 58 and underneath the stub guides 59.

The stub guides are laterally adjustable because they are mounted on the portions 61 by a pin, in this case a screw 62, received in a slot 63 which extends laterally through the stub guides 59. The stub guides 59 include inner guide portions 65 (FIG. 1) which extend slightly from the plane of the base plate 58.

The assembly 37 is slid to the top edge of surface 23 as shown in FIG. 3 for use on a stub wall 55. The stub wall 55 is generally narrower than the applicator 21 and includes opposite outside corner edges 54 of the stub wall. The stub wall guides 59 can be laterally adjusted in the directions of Arrow E so that each of the inner guide portions 65 engage a corresponding outside corner edge 54. The applicator 21 is thus guided along the two opposite corners 54 of the stub wall 55. The rollers 39 contact the flat surface of the stub wall 55.

When the assembly 37 is in the engaged position, as shown in FIG. 3, side portions of the outlet 27 become covered by the portions 61 of the assembly 37, as well as by parts of the stub wall guides 59, 59 which extend inwardly from the portions 61. The position of the side edges 29' is thus shifted or varied inwardly from that of side edges 29 (shown in dotted lines on FIG. 3), thereby narrowing the width of the outlet 27 to correspond to the width of the stub wall 55. Thus, mastic does not exit the outlet 27 at locations where there are no underlying surface areas to receive the mastic.

The assembly 37 includes stub wall skids 67 near the stub wall guides 59 and extending transversely along the top edge of the base plate 58. The stub wall skids 67 extend generally parallel to but slightly above the plane of the base plate as shown in FIG. 1. When the assembly 37 is positioned as shown in FIG. 3, the geometry of the applicator surface 23 allows it to contact the stub wall 54 at the rollers 39 and the stub wall skids 67 without substantial contact with the blade 35. When the corner metal or plastic strips 54 include a rigid raised bead portion, the ability to avoid contact between the blade 35 and the corners 54 saves unnecessary wear and tear on the blade 35.

From the foregoing description, the applicator 21 embodying the present invention is used by placing and moving the applicator surface 23 over an area, such as a wall joint, to receive mastic. When the wall joint is a flat joint, both of the corner guide plates 31*a* or 31*b* retract upon contact with the flat wall surfaces on either side of the flat joint. Alternately, the corner guide plates 31*a* or 31*b* can be locked by set screws 43 (FIGS. 1, 2) or latch L and keeper K (FIG. 1A) in a retracted position. The assembly 37 is preferably locked in its lower position and is thereby disengaged from significant contact with the flat joint to receive the mastic.

As best seen in FIG. 2, when the applicator 21 is applied at an area adjacent to an outside corner, one of the corner guide plates 31*a* or 31*b* engages the corner of the wall while the other corner guide is in contact with the flat surface to retract it to be generally coplanar with the applicator surface 23. Again, the assembly 37 is preferably locked in its lower, disengaged position except when finishing stub walls.

Referring now to FIG. 3, the applicator 21 is applied to stub walls by moving the assembly 37 toward the top of the applicator 21. If necessary, the stub wall guides 59 are laterally adjusted to engaged the opposite corners 54 of the stub wall. The portions 61 of the assembly 37, as well as inner portions of the stub wall guides 59, cover the sides of the outlet 27 to keep unnecessary mastic from exiting where there is no stub wall to receive it.

The assembly 37, corner guides 31*a* or 31*b*, and many other parts including the side plates 25, applicator surface 23, pressure plate, and the like, are preferably machined metal parts, although polymeric plastic material may also be used. Preferably, the lateral spacing between the stub wall guides 59 can be adjusted between about 4 ⅝" to about 4 ⅞", which, at the low end of the range, accommodates the longer side of a standard 2×4 with two panels of half-inch drywall on either side and two, one-sixteenth inch corner beads at each of the corners 54. At the high end of the range, the guides accommodate the same configuration using a commercial drywall thickness of ⅝". Of course, alternative lateral adjustments for the stub wall guides 59 could be provided for stub walls and drywall panels of varying thicknesses.

The width of the outlet 29 is slightly wider than outlets in traditional mastic applicators so that mastic exits closer to the side walls 25 of the housing and in alignment with the guide surfaces 33.

The inventive applicator 21 may optionally be equipped with means for adjusting the blade 35 so that the thickness of the applied mastic coat can be varied. Such adjusting means may comprise a crown adjustment (not shown) with multiple cam surfaces which vary the pressure on the blade 35 and thereby allow more or less of the mastic to be deposited on the desired surface. The guides 31, 59 are positioned in relation to the applicator surface 23 and the blade 35 so that the guides function as described above irrespective of how the blade 35 may be adjusted.

In addition to the advantages apparent from the above description, the inventive applicator has various additional advantages over the prior art. For example, an application of mastic to both flat joints and outside corner joints can be accomplished by one tool. There is no need for a separate set of outside corner tools to be purchased for and brought to a job.

The present invention has the advantage of allowing drywall finishing to be accomplished more quickly and with less fatigue on those performing the job, as compared to the prior art use of knives or other tools.

Outside corners with and without corner beads can receive mastic uniformly and without gaps between the mastic and the edge of the corner.

A further advantage is the ability to vary the width of the outlet so that opposing outside corners, such as on stub walls, can be effectively coated with mastic.

While the present invention has been described with reference to a preferred embodiment thereof, illustrated in the accompanying drawings, various changes and modifications can be made by those skilled in the art without departing from the spirit and scope of the present invention; therefore, the appended claims are to be construed to cover equivalent structures.

What is claimed is:

1. An applicator for applying drywall mastic to either flat drywall joints or outside corner drywall joints, said applicator comprising:

a mastic housing having at least an applicator surface and a pair of side surfaces, said applicator surface having an aperture for mastic to move from an interior of said housing to a drywall with said applicator surface smoothing said mastic as it so moves, a corner guide plate pivotally mounted on each of said side surfaces, to move between deployed and retracted positions, a projection on each of said guide plates for extending beyond said applicator surface when said guide plate is deployed in order to track an outside edge of a drywall corner joint and for not extending beyond said applicator surface when said guide plate is in said retracted position in order to move over a flat surface of a drywall joint, said projection and a side of said aperture being aligned so that said mastic is deployed to the comer edge against which said projection tracks, resilient means for applying a bias strong enough to normally urge said guide plate to a deployed position beyond said applicator surface, said bias being weak enough to enable said guide plate to move to a retracted position responsive to using said applicator against a flat surface, whereby said guide plate normally pivots to extend said projection so that it can ride against an outside edge of a drywall corner joint or pivots to remove said projection under conventional working pressure against a flat drywall.

2. The applicator of claim 1 wherein said aperture extends up to said projection so that said mastic flows up to the edge of said outside drywall corner joint.

3. The applicator of claim 1 and a pair of laterally spaced stub wall guides mounted on said applicator surface for simultaneously applying mastic up to two outside corners on an end of a stub wall.

4. The applicator of claim 1 and a pair of side skids mounted on adjacent said edges of said aperture, said skids being in positions to abut against a surface for receiving said mastic applied through said aperture.

5. The applicator of claim 1, wherein the mastic aperture has elongated edges extending between side edges to form an outlet aperture extending substantially across the width of the housing, stub wall guides mounted on the applicator surface and slidable transversely to the elongated edges of the mastic outlet, the stub wall guides being slidable between a first position away from and not obstructing the mastic aperture and a second position to cover and obstruct a portion of the mastic outlet aperture in order to match said outlet to a width of a stub wall.

6. The applicator of claim 5, wherein the applicator surface includes contact points defining a plane of contact when the applicator surface is against a surface which receives said mastic, the stub wall guides being mounted on a substantially flat base plate to form a stub wall guide assembly, the stub wall guide assembly having stub skids disposed thereon, the first position of the stub wall guides locating the stub wall guide assembly in a plane above the plane of contact relative to the drywall surface which receives the mastic, whereby the stub wall guide assembly does not affect an application of the mastic to the surface which receives the mastic, and the second position of the stub wall guides locating the stub skids in the plane of contact, whereby the contact points include the stub skids when the stub guides are in the second position.

7. The applicator of claim 5, wherein the stub wall guides are adjustable in relation to each other to vary the amount of lateral spacing between the stub wall guides, the stub wall guides having portions positionable to cover the side edges of the mastic outlet.

8. The applicator of claim 7, wherein the stub wall guides have stub wall skids adapted to contact the drywall surface which receives the mastic.

9. The applicator of claim 1 and means for selectively capturing said corner plates in a retracted position.

10. The applicator of claim 9 wherein said means for capturing said corner plate in a retracted position is a thumb screw.

11. The applicator of claim 9 wherein said means for capturing said corner plate is a spring biased latch.

12. A drywall mastic applicator for either a flat surface or outside corner, said applicator comprising:

a housing with an applicator surface and an outlet aperture in the applicator surface through which mastic flows onto a drywall surface, the outlet aperture having opposite side edges; and means for guiding at least one of the side edges of the outlet aperture along, and in alignment with, an outside edge of a drywall corner;

the guiding means comprising a spring biased corner guide plate normally movable to a first position extended from the applicator surface to engage and ride against the outside edge of the drywall corner and moveable against said spring bias to a second position which is coplanar with the applicator surface in response to a placement of the applicator against a flat surface, so that when one of the corner guides is engaged at the outside drywall corner, no manual adjustment of the other corner guide plate is required.

13. The applicator of claim 12 further comprising a pair of wheels on said applicator surface at locations remote from said outlet aperture, and wherein the means for guiding said at least one edge comprises a projection on said corner guide plate which extends beyond said applicator surface and rides against the outside edge of the drywall corner when said guide plate is in said first position, said wheels having a circumferential flange which also rides against the outside edge of the drywall corner thereby giving said applicator two stable points bearing against said outside corner.

14. The applicator of claim 12 further comprising means for varying the position of at least one of the side edges of the outlet aperture by covering at least said one of the sides of the outlet aperture for applying mastic to a surface having two outside corners, the guiding means further comprising a pair of stub wall guides laterally spaced from each other and connected to the applicator surface, the stub wall guides being adjustable to vary the lateral distance between the stub wall guides in order to fit a width of a stub wall, so that when the width of the stub wall between the two outside corners is an amount less than or equal to the spacing between the stub wall guides, the outside edges of the surface are engageable by the stub wall guides.

15. A multi-purpose applicator for applying drywall mastic to flat drywall joints, or to outside corner drywall joints, or simultaneously to a pair of outside corner drywall joints, said applicator comprising:

a housing having at least one applicator surface having side walls on opposite surfaces of said housing, an elongated mastic outlet aperture extending from side to side across a width of said applicator surface, a lever pivoted to swing about a midpoint mounted on each of said side walls, one end of each of said levers having a projection aligned with an individually associated end of said elongated aperture, said projection being adapted to ride on an edge of said outside of drywall corner, each of said levers having a spring bias urging said lever to swing so that said projection extends beyond said application surface, said spring bias being strong enough to hold said projection in said extended position while said applicator is moved along an outside edge of an outside drywall corner and being weak enough to push said projection back to said application surface responsive to moving said applicator across a flat drywall surface, and latch means for securing said lever in a position where said projection is remote from said applicator surface.

16. The applicator of claim 15 wherein said latch means is a spring biased push button controlling a sliding latch engaging a keeper on said lever.

17. The applicator of claim 15 further comprising a pair of wheels adjacent said applicator surface and remote from said outlet aperture, each of said wheels having a circumferential flange adapted to ride along said edge of said outside drywall corner, said projection and said circumferential flange being aligned to give a two point stability to said applicator as it moves along said drywall surface of an outside corner.

18. The applicator of claim 17 wherein said spring bias is applied to an end opposite said one end, a keeper formed on said opposite end, and said latch means is a spring biased push button for removing said latch from said keeper.

19. The applicator of claim 18 and a pair of guide means attached to said applicator surface, said pair of stub wall guide means being adjustable in order to space them to correspond to the width of an end of a stub wall, and means associated with said pair of guide means for covering at least part of said elongated mastic outlet aperture in order to give the aperture said width of an end of said stub wall.

20. The applicator of claim 19 further comprising a stub wall panel movably mounted on said applicator surface for carrying and supporting said pair of guide means and said means for covering part of said aperture, said stub wall panel being movable to a first position away from said aperture and to a second position at said aperture.

21. The applicator of claim 14 further comprising a pair of wheels on said applicator surface at locations remote from said outlet aperture, said wheels having a circumferential flange and sufficient lateral distance between said wheels in order to ride against the two outside corners of the stub wall.

* * * * *